US008028868B2

(12) United States Patent
Mangano

(10) Patent No.: US 8,028,868 B2
(45) Date of Patent: Oct. 4, 2011

(54) GARMENT ARRANGEMENT SYSTEM

(75) Inventor: Joy Mangano, St. James, NY (US)

(73) Assignee: Ingenious Designs, LLC, Ronkonkoma, NY (US)

( * ) Notice: Subject to any disclaimer, the term of this patent is extended or adjusted under 35 U.S.C. 154(b) by 39 days.

(21) Appl. No.: 12/010,477

(22) Filed: Jan. 25, 2008

(65) Prior Publication Data

US 2009/0188954 A1 Jul. 30, 2009

(51) Int. Cl.
*A41D 27/22* (2006.01)

(52) U.S. Cl. ..... 223/85; 223/91; 223/92; 223/93; 38/102

(58) Field of Classification Search ..... 223/85, 223/88, 92, 69, 91, 93, 96; 24/DIG. 29, DIG. 13; 38/102
See application file for complete search history.

(56) References Cited

U.S. PATENT DOCUMENTS

| | | | | | |
|---|---|---|---|---|---|
| 82,666 | A | * | 9/1868 | Wells | 38/102 |
| 526,651 | A | * | 9/1894 | Hathaway | 38/102 |
| 1,435,674 | A | * | 11/1922 | Varga | 24/DIG. 13 |
| 1,838,601 | A | * | 12/1931 | Wilson | 38/102 |
| 1,913,710 | A | * | 6/1933 | Huff | 38/102 |
| 1,940,600 | A | * | 12/1933 | Maves et al. | 38/102 |
| 1,962,889 | A | * | 6/1934 | Bateman | 38/102 |
| 1,986,119 | A | * | 1/1935 | Rosenberg | 223/92 |
| 1,990,454 | A | | 2/1935 | Johnston | |
| 2,546,717 | A | * | 3/1951 | Beetlestone et al. | 223/96 |
| 2,617,568 | A | * | 11/1952 | Pechtel | 223/96 |
| 2,765,487 | A | * | 10/1956 | Foster | 24/DIG. 13 |
| 2,922,209 | A | * | 1/1960 | Longhi | 24/DIG. 13 |
| 3,790,043 | A | * | 2/1974 | Hagen | 223/96 |
| 4,006,826 | A | | 2/1977 | Rich | |
| 4,431,108 | A | | 2/1984 | Lee | |
| 4,438,874 | A | | 3/1984 | Zuckerman et al. | |
| 4,892,238 | A | | 1/1990 | Pinczykowski | |
| 4,894,935 | A | | 1/1990 | Kretz | |
| 4,895,283 | A | | 1/1990 | Evangelist et al. | |
| 4,905,877 | A | | 3/1990 | Gatling | |
| 5,022,569 | A | | 6/1991 | Beaulieu | |
| 5,029,739 | A | | 7/1991 | Blanchard et al. | |
| 5,277,345 | A | | 1/1994 | Ozaki | |
| 5,305,484 | A | * | 4/1994 | Fitzpatrick et al. | 223/70 |
| 5,603,438 | A | | 2/1997 | Jugan | |
| 5,613,628 | A | | 3/1997 | Burkhalter | |
| 5,613,630 | A | | 3/1997 | Isenga et al. | |
| 5,927,570 | A | | 7/1999 | Beverly | |
| 5,927,571 | A | | 7/1999 | Richards | |
| 6,000,588 | A | | 12/1999 | Kolton et al. | |
| 6,039,225 | A | * | 3/2000 | Zimmerman | 223/85 |
| 6,116,482 | A | * | 9/2000 | Heiber | 223/96 |
| 6,431,418 | B1 | | 8/2002 | Pease | |
| 6,675,997 | B1 | | 1/2004 | Gouldson et al. | |
| 6,749,093 | B2 | | 6/2004 | Harris | |
| 6,915,931 | B2 | | 7/2005 | Gouldson et al. | |
| 7,104,428 | B2 | | 9/2006 | Gouldson | |
| 7,182,232 | B2 | | 2/2007 | Fleming et al. | |

(Continued)

*Primary Examiner* — Gary L Welch
*Assistant Examiner* — Nathan Durham
(74) *Attorney, Agent, or Firm* — Kenyon & Kenyon LLP

(57) ABSTRACT

Embodiment of the invention provide a garment support system, which may include a garment hanger and a garment bar physically unconnected to the hanger that can attach to the bottom of a garment supported by the hanger. The garment bar may include one or more clips for attaching the supporting to a garment. The support also may be weighted to provide additional support to the garment and/or to maintain a garment in a desired configuration.

3 Claims, 8 Drawing Sheets

U.S. PATENT DOCUMENTS

2003/0019087 A1* 1/2003 Pasin et al. ..... 24/545
2004/0004096 A1 1/2004 Gouldson et al.
2004/0020949 A1 2/2004 Yip
2004/0089682 A1 5/2004 Beverly
2004/0222252 A1 11/2004 Gouldson et al.
2005/0011917 A1 1/2005 Tubman et al.
2005/0061839 A1 3/2005 Fradkin
2005/0284899 A1 12/2005 Fleming et al.
2006/0011670 A1 1/2006 Pluchino et al.
2006/0011673 A1 1/2006 Gouldson
2006/0124563 A1 6/2006 Penson
2006/0207956 A1 9/2006 Sivers
2006/0243764 A1 11/2006 Chiang
2006/0278671 A1 12/2006 Gouldson
2007/0007312 A1 1/2007 Kraus, Jr.
2007/0017941 A1 1/2007 Baessler et al.
2007/0029354 A1 2/2007 Hunt et al.
2007/0151998 A1 7/2007 Wong
2007/0158373 A1 7/2007 Yau
2007/0194064 A1* 8/2007 Elder ..... 223/89
2007/0210124 A1 9/2007 Dikes
2007/0257071 A1 11/2007 Gouldson
2007/0295769 A1 12/2007 Burroughs

* cited by examiner

GARMENT ARRANGEMENT SYSTEM

BACKGROUND

Garment hangers and other devices are used to hold, support, store, and organize garments when they are not being worn. Various specialty hangers are known, such as for storage of multiple garments in a reduced space, for garment display and presentation, and for supporting a garment while it is cleaned, repaired, or otherwise manipulated. Conventional hangers operate by providing support for the top of a garment and allowing the rest of the garment to hang freely from the hanger. Some specialty hangers are intended to maintain a specific shape or configuration of a garment disposed on the hanger, such as where a garment hanger has multiple support portions for various garment components such as sleeves, legs, straps, and waistbands. Garment hangers to hold multiple garments are also known, such as where a single hanger has multiple horizontal bars each of which is intended to hold a separate garment.

Some garment hanger systems may include multiple, physically distinct portions. One such type of system is a multiple-hanger system, where each hanger includes a support from which another hanger may be supported, allowing for a series of hangers to be supported from the same initial support. In these systems, each hanger performs the same function as if it was an individual hanger with respect to each garment, by providing support for the top portion of the garment and allowing the bottom portion to hang freely from the hanger.

DETAILED DESCRIPTION

Embodiments of the invention provide a garment support system, which may include a garment hanger and a garment bar physically unconnected to the hanger that can attach to the bottom of a garment supported by the hanger. The garment bar may include one or more clips for attaching the support to a garment. The support also may be weighted to provide additional support to the garment and/or to maintain a garment in a desired configuration.

Figure 1:
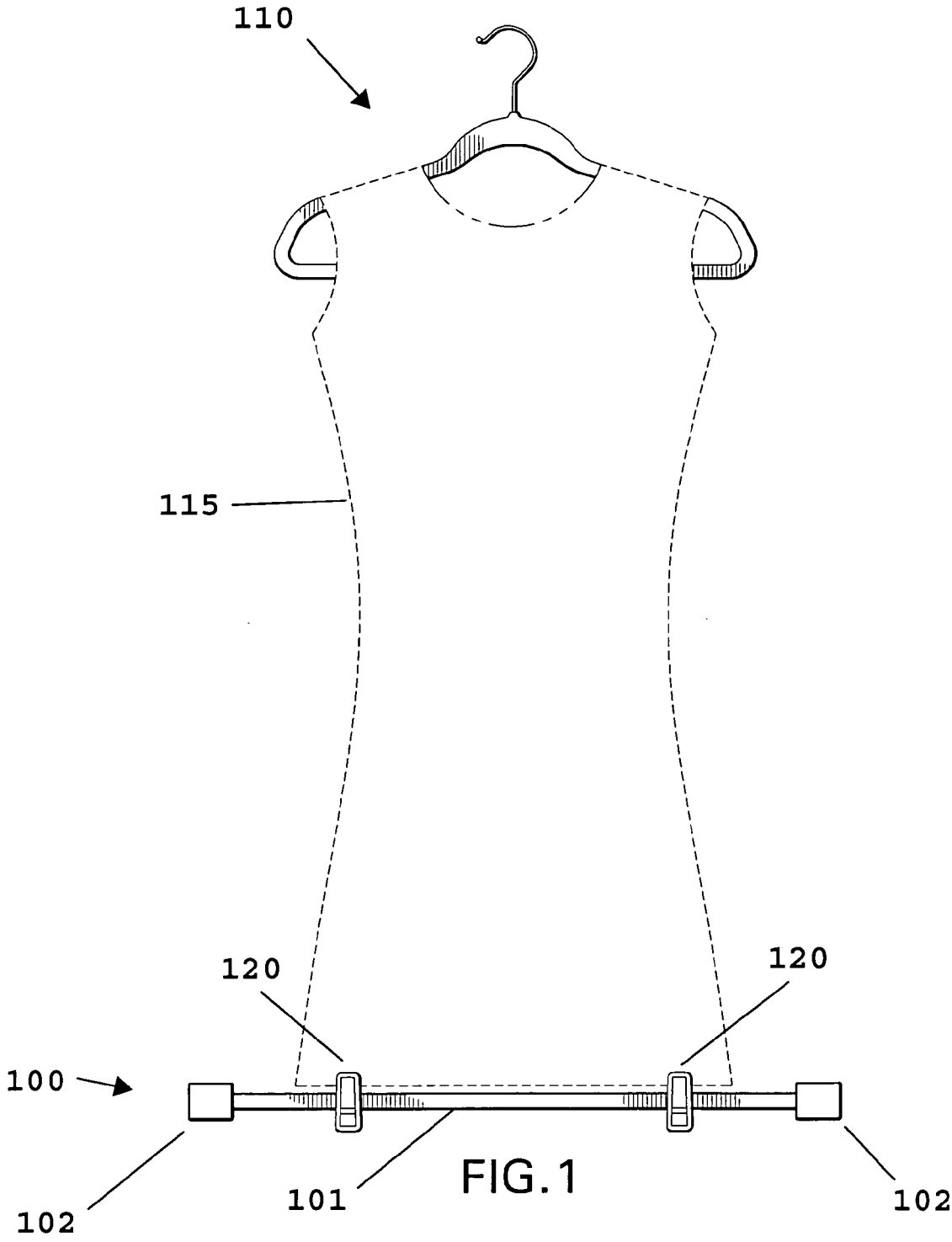
FIG. 1 shows a front view of a garment arrangement system according to an embodiment of the invention.
Figures 2, 3:
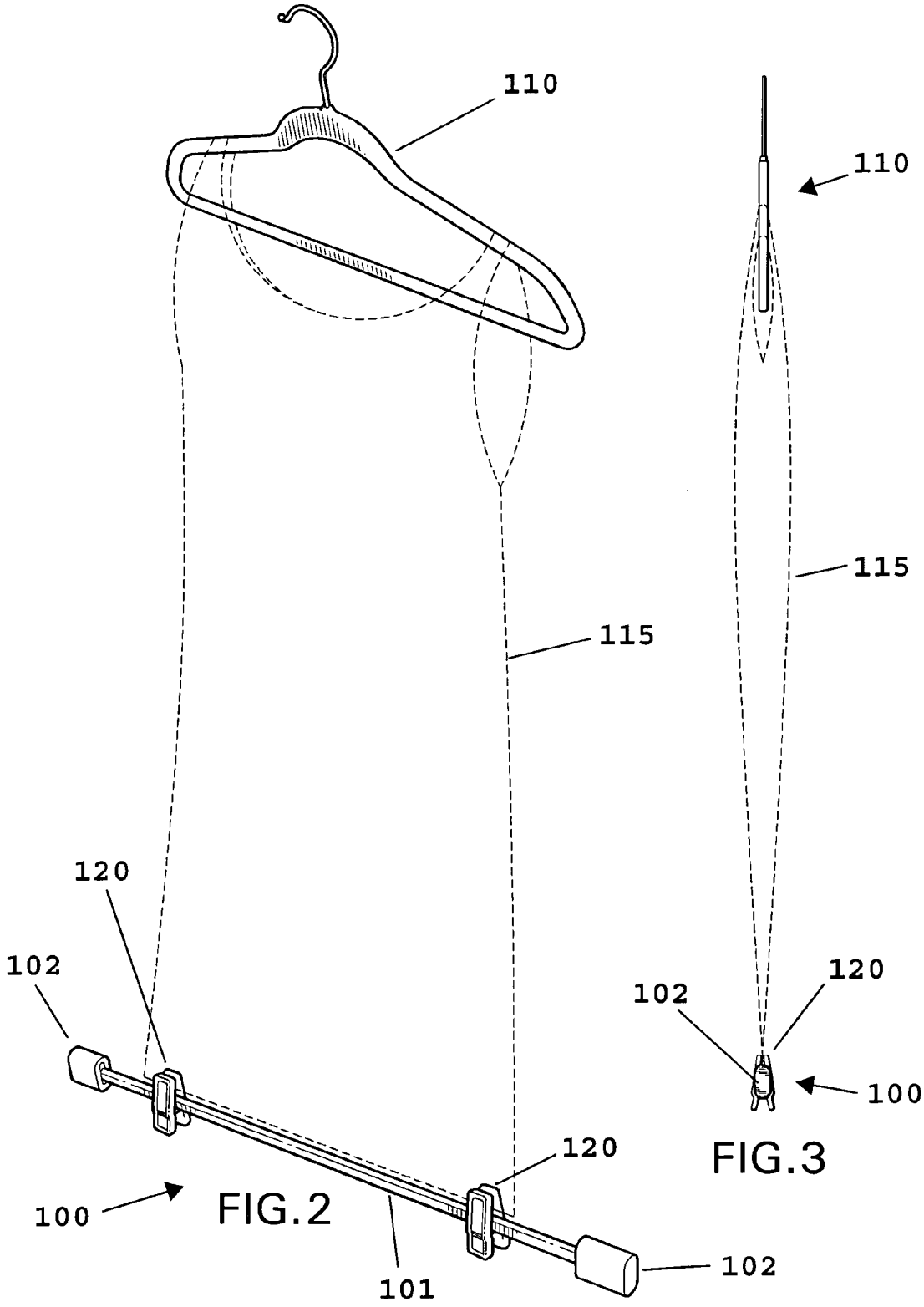
FIG. 2 shows a perspective view of a garment arrangement system according to an embodiment of the invention.
FIG. 3 shows a side view of a garment arrangement system according to an embodiment of the invention.
Figure 4:
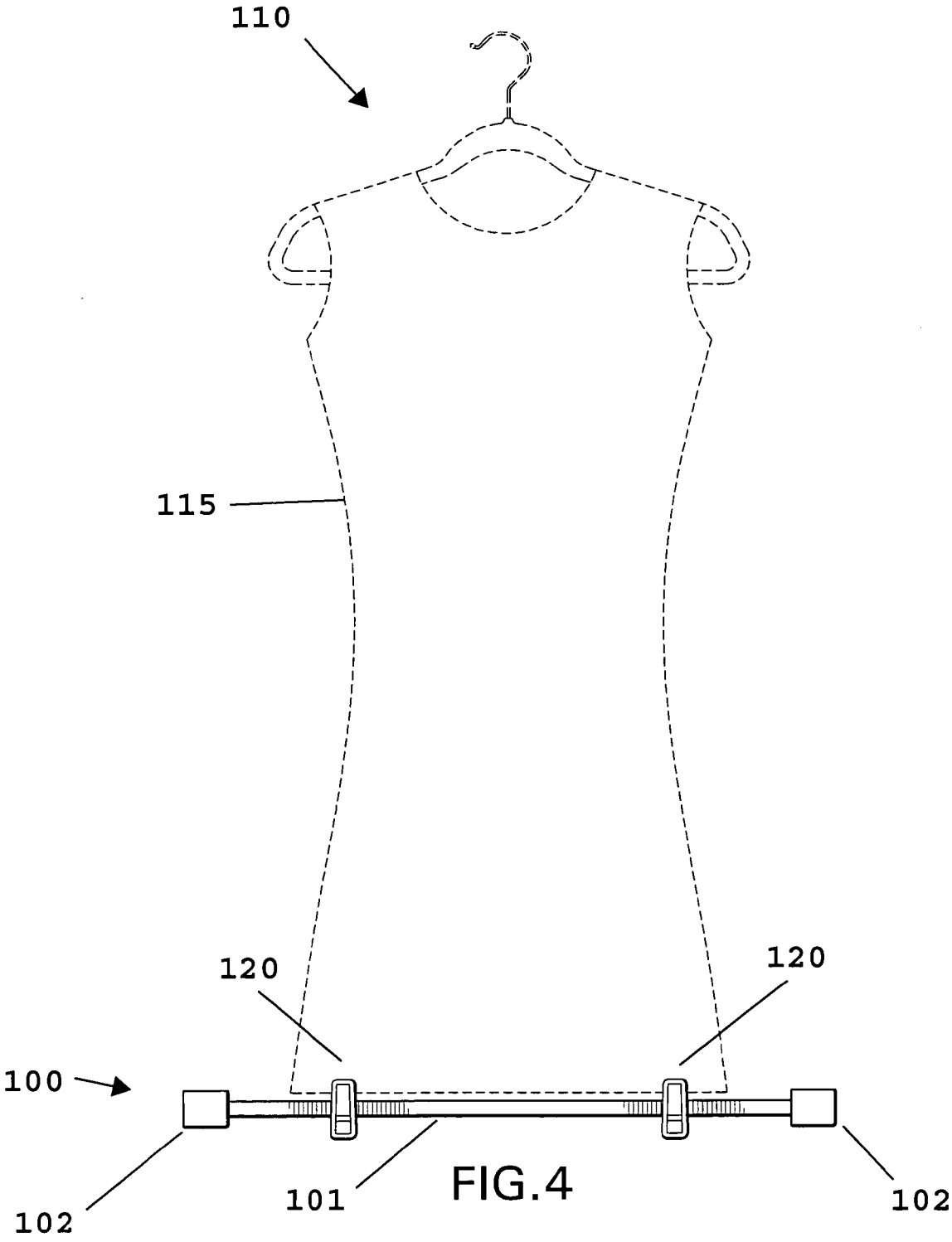
FIG. 4 shows a front view of a garment arrangement system according to an embodiment of the invention.
Figures 5, 6:
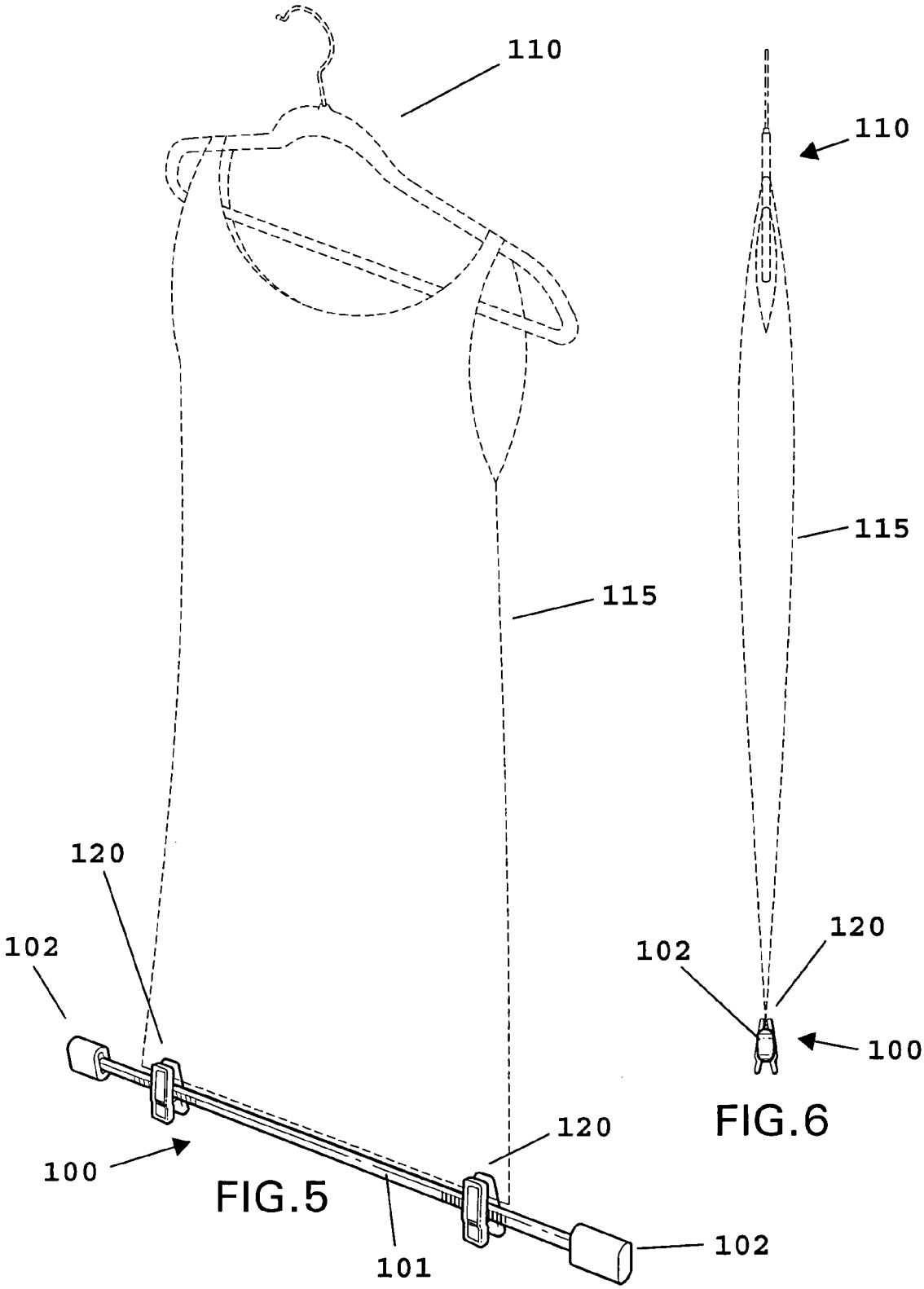
FIG. 5 shows a perspective view of a garment arrangement system according to an embodiment of the invention.
FIG. 6 shows a side view of a garment arrangement system according to an embodiment of the invention.
Figure 7:
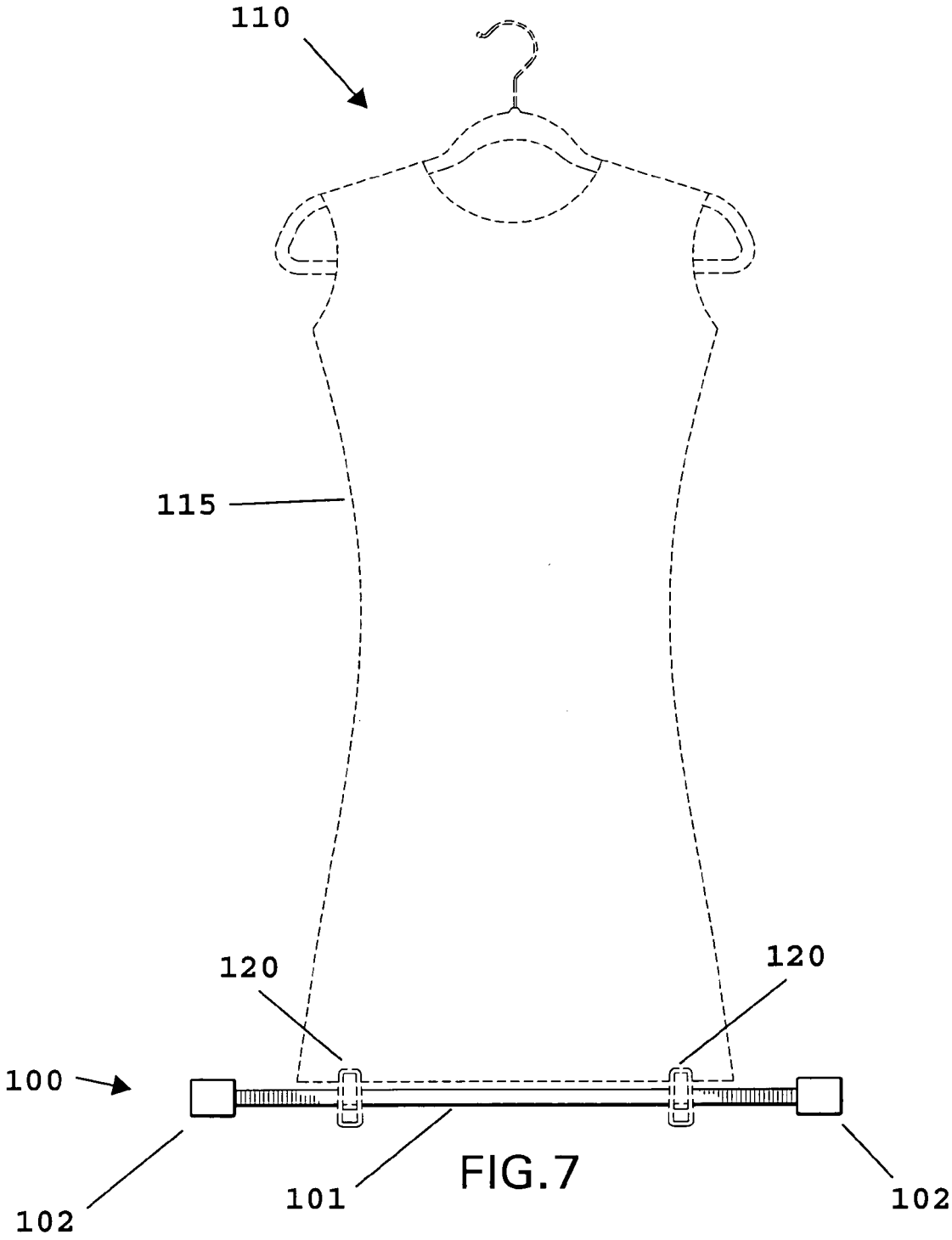
FIG. 7 shows a front view of a garment arrangement system according to an embodiment of the invention.
Figures 8, 9:
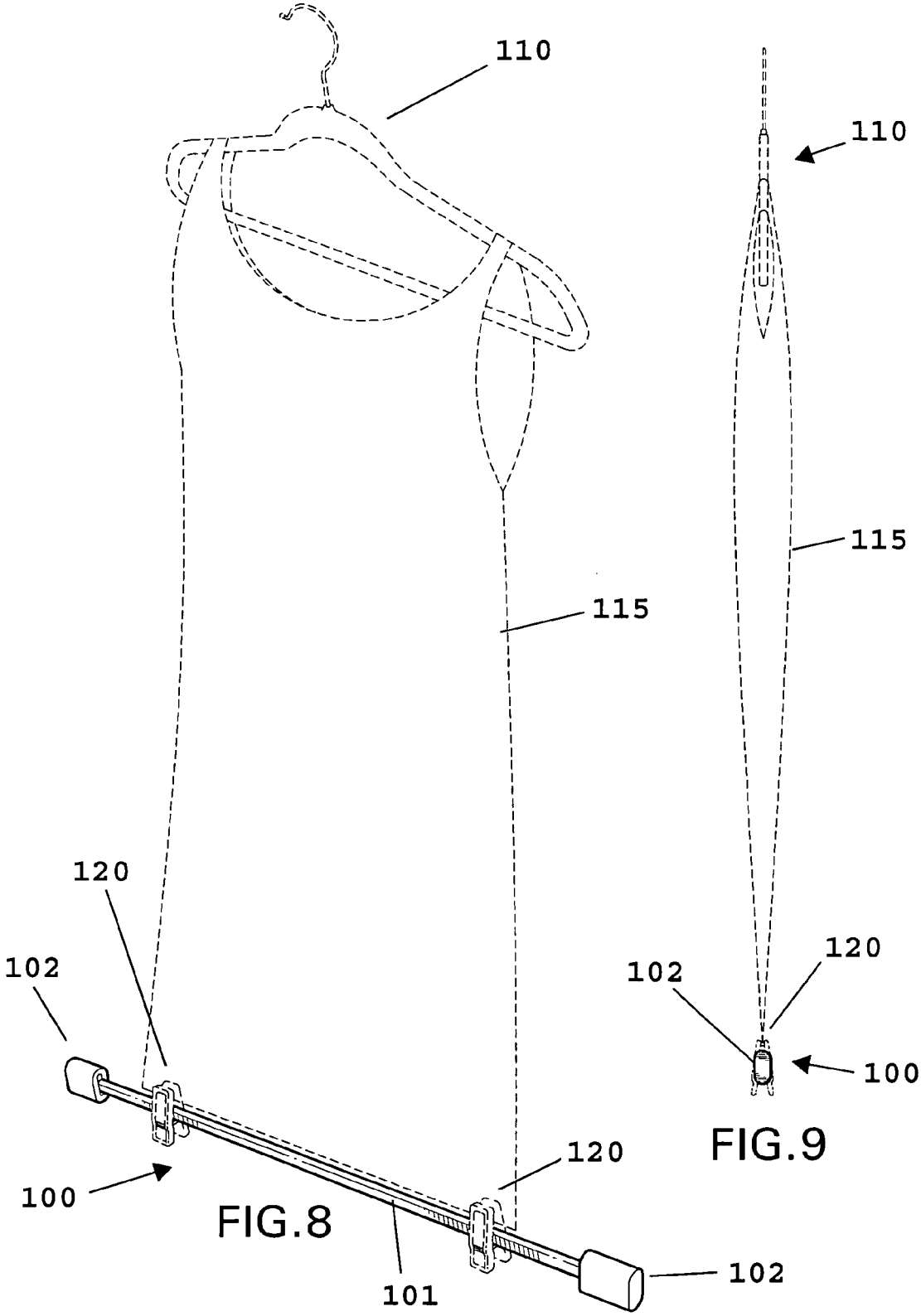
FIG. 8 shows a perspective view of a garment arrangement system according to an embodiment of the invention.
FIG. 9 shows a side view of a garment hanger arrangement according to an embodiment of the invention.
Figure 10:
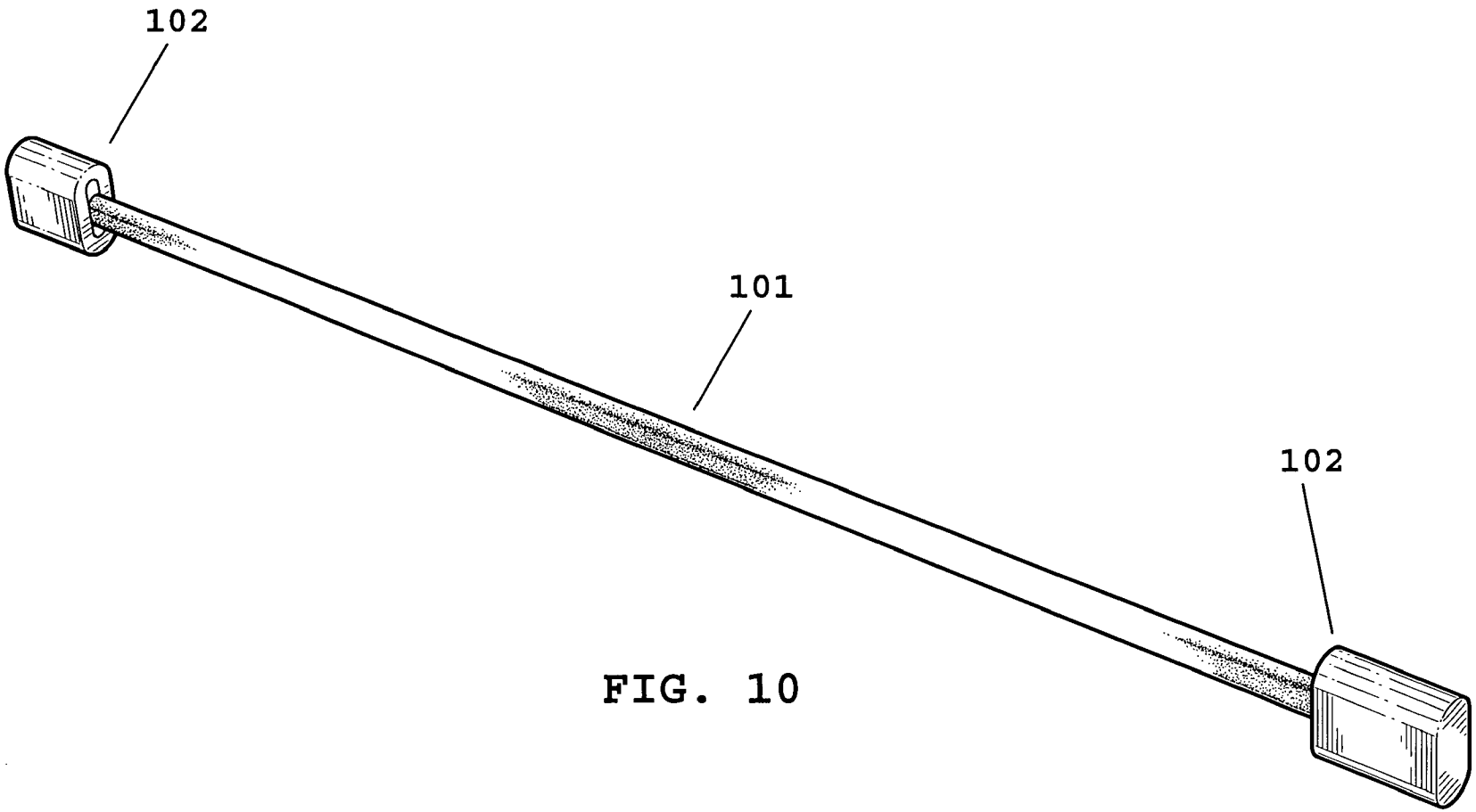
FIG. 10 shows a perspective view of a garment bar according to an embodiment of the invention.
Figure 11:
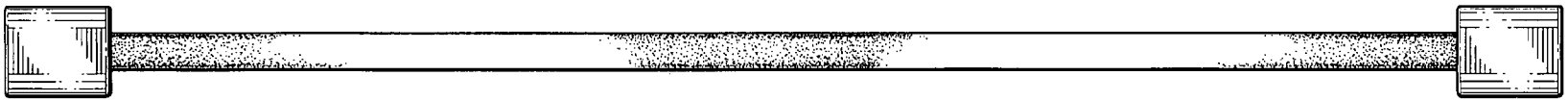
FIG. 11 shows a front view of a garment bar according to an embodiment of the invention.
Figure 12:
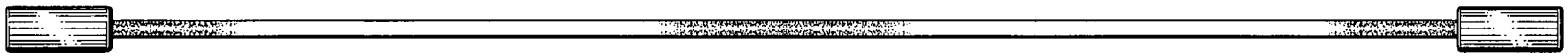
FIG. 12 shows a top view of a garment bar according to an embodiment of the invention.
Figure 13:
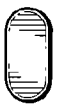
FIG. 13 shows a side view of a garment bar according to an embodiment of the invention.

FIGS. 1-9 show a garment support system according to embodiments of the invention. FIGS. 10-13 show detailed views of a lower garment support according to embodiments of the invention. The system may include a garment hanger 110 and a garment bar 100. A garment 115 may be disposed on the hanger 110, typically by placing the garment on or over the hanger so that the hanger supports the top part of the garment and the bottom part of the garment hangs freely from the hanger. The garment bar 100 may include a central portion such as the elongated member 101 and one or more weights 102. The garment bar also may include one or connectors such as clips 120 to removeably attach the support to a the garment 115.

In operation, a garment may be hung from the garment hanger 110 and the garment bar 100 attached to a bottom portion of the garment. When attached to the garment, the garment bar 100 may provide stability or structure to the garment. For example, the garment bar may hold the fabric of the garment taut while the garment is being cleaned, brushed, or steamed. It may perform other functions, such as holding the garment in a desired configuration. Such features may be desirable, for example, when used with garments constructed from flimsy, thin, stretchable, fragile, or similar materials.

The garment bar 100 may be physically separate and disconnected from the garment hanger 110. That is, there may be no permanent or removable object connecting the garment hanger and the garment bar other than a garment with which the bar and hanger are used. This may allow systems according to the invention to be used with a wide variety of garment shapes and sizes. It also may allow the garment bar to be used separately from the garment hanger, such as with a different hanger system or when the top portion of a garment is supported by a different type of structure. It also may allow the garment bar to be stored, replaced, or otherwise addressed separately from any specific hanger or other garment support.

The weights 102 may be removeably or permanently attached to the central portion 101 of the garment bar. Any suitable amount of weight may be used. In some embodiments, exemplary weights are about 10 g to about 50 g each. Different weights may be placed on or removed from the garment bar to achieve a desired total weight. Multiple weights may be used. As a specific example, the total weight may be 100 g, 200 g, or other suitable weight. In some embodiments, the central portion is itself weighted, and may include or exclude one or more identifiably distinct weights. In other embodiments, the weight of the central portion 101 may be sufficient to hold a garment in a desired position without additional weight.

One or more clips 120 may be attached to the garment bar 100. The clips may be permanently or removeably attached to the central portion 101 and may be positionable at any location along the length of the central portion 101. For example, two clips may be attached to the support and then removeably attached to the garment 115 to attach the garment bar 100 to the garment. The clips may be attached along the length of the lower portion of the garment, such as the bottom hem of a garment, or they may be positioned at any other desired location on the garment. The clips may be attached to the front and back portions of a garment, as illustrated, or they may be attached to only the front or back portion of a garment. For example, the one or more clips may be attached to a single leg of a pair of pants.

The central portion 101 of the garment bar 100 may have a rectangular cross section. As used herein, a rectangular cross section refers to a cross section taken perpendicular to the longest or major axis of the central portion, where the cross section has a rectangular, approximately rectangular, or rounded rectangular shape. When used with a garment hanger, the garment bar 100 and clips 120 may be arranged so that the garment bar is positioned with the major axis of the cross section parallel to the plane defined by the garment hanger, as illustrated. The central portion may have a cross section of any other shape.

The garment bar 100, and specifically the central portion 101 may be any length. As an example, the central portion 101 may have a length equal or approximately equal to the width of the garment hanger. As another example, the central portion may be longer than the width of the garment hanger. Such a configuration may be used when the garment hanger and garment bar are used with a flared garment such as a skirt or dress.

In some embodiments, the garment bar 100 may extend a minimal distance above or below the bottom of a garment to which it is attached. That is, the garment bar 100 may have a relatively small height. This may prevent the use of the garment bar 100 from requiring that a garment to be positioned between the bar and a garment hanger is placed higher than would be convenient while working with or manipulating the garment. It also may prevent the garment bar from extending into the region occupied by the garment, where it could interfere with manipulation or use of the garment, such as where the garment is to be steamed. For example, in an embodiment the garment bar 100 has a height of not more than about 2.5 cm. As another example, the central portion 101 may be relatively small, and weights 102 may be larger. In another exemplary embodiment, the central portion 101 is not more than about 2.5 cm in height, and the weights are not more than about 5.0 cm in height. Other dimensions may be used. For example, the central portion may be about 1.0 cm to about 3.0 cm in height, and the weights, if present, may be about 1.0 cm to about 6.0 cm. Typically, the garment bar may attach to the garment such that it is substantially or entirely positioned below the garment. In some configurations, only a small portion of clips 120 or other fasteners may extend above the bottom of the garment to which the garment bar is attached.

The garment bar may be shaped differently than the specific configurations described and illustrated herein. For example, instead of a straight bar the garment bar may be curved, waved, or circular, and may have a different cross section. Specific shapes may provide additional support to various types of garments, and/or be suited to particular storage arrangements.

While the present invention is described with respect to particular examples and preferred embodiments, it is understood that the present invention is not limited to these examples and embodiments. The present invention as claimed therefore includes variations from the particular examples and preferred embodiments described herein, as will be apparent to one of skill in the art.

What is claimed is:

1. A garment support system comprising:

a garment hanger including a hook protruding from a main body of the hanger;

a garment bar physically unconnected to the garment hanger, the garment bar comprising:

an elongated member having a first end and a second end;

a first weight removeably attached to the first end;

a second weight removeably attached to the second end; and at least two clips attached to the elongated member between the first end and the second end, the at least two clips attach to the bottom portion of a garment hung from the garment hanger disposed above the device;

wherein the elongated member has an engaged position in which the clips are attached to the garment and which is freestanding when the elongated member is not in the engaged position and attached to the garment, wherein the elongated member is longer than the width of the garment hanger in the engaged position, wherein the elongated member does not include a hook, and wherein each weight has a weight between 10 g to 50 g.

2. The system of claim 1, wherein the elongated member has a rectangular cross-section.

3. The system of claim 2, wherein the at least two clips and the elongated member are configured to position the elongated member to have a longest axis of the cross section arranged parallel to the plane of the garment hanger.

* * * * *